US005813584A

United States Patent [19]

Mauser

[11] Patent Number: 5,813,584

[45] Date of Patent: Sep. 29, 1998

[54] STUFFED TOY CARRIER

[75] Inventor: Ann Carlisle McKay Mauser, Boynton Beach, Fla.

[73] Assignee: Carlisle Showers, Inc., Boynton Beach, Fla.

[21] Appl. No.: 851,228

[22] Filed: May 5, 1997

[51] Int. Cl.[6] ..... A45F 5/00

[52] U.S. Cl. ..... 224/605; 224/649; 446/28

[58] Field of Search ..... 224/605, 647, 224/648, 649, 158, 159, 219, 222; 446/26, 28, 73

[56] References Cited

U.S. PATENT DOCUMENTS

| | | | |
|---|---|---|---|
| 2,376,657 | 5/1945 | Chamberlain | 224/159 |
| 2,593,218 | 4/1952 | Swain | 446/28 X |
| 2,628,452 | 2/1953 | Gladstein | 446/28 |
| 4,676,419 | 6/1987 | Victor | 224/649 |
| 5,210,881 | 5/1993 | Stocker, Jr. et al. | 446/28 X |
| 5,644,785 | 7/1997 | Garrett | 224/605 X |

*Primary Examiner*—Renee S. Luebke
*Attorney, Agent, or Firm*—McHale & Slavin, PA

[57] ABSTRACT

A stuffed toy carrier for attachment to a strap or the like object by use of a reusable hook and pile fastener. The carrier allows for securement of a stuffed toy as well as ease of accessibility to the toy. The carrier forms a pocket-like structure having a top opening constricted by an elastic band formed integral to the upper rim and a first and second aperture for positioning the legs of the stuffed toy.

15 Claims, 2 Drawing Sheets

STUFFED TOY CARRIER

FIELD OF THE INVENTION

This invention is related to stuffed toys, and in particular to a stuffed toy carrier that can be attached to a strap such as that found on a child's backpack, purse or belt loop for securement of a stuffed toy.

BACKGROUND OF THE INVENTION

Stuffed toys are enjoyed by children of all ages. The toys may be used for entertainment and in many instances for purposes of collecting. Stuffed toys typically consist of small animal shaped objects constructed from a soft material. The toys are stuffed with a material providing support should the toy be placed in a particular position. Stuffed toys may include, but are not limited to, teddy bears, Barbie dolls, and a current wave of popular stuffed toys such as those sold under the trademark BEANIE BABIES. Typically, BEANIE BABIES brand plush toys are animal replicas constructed from a soft cloth material stuffed with plastic beads allowing the toy to be placed into various positions while retaining a particular shape.

Many toys are considered collector items having been produced in a limited quantity. Thus, while a child may use a toy for enjoyment, the proper maintenance of the toy may, in some instances, be considered an investment. As with any investment, the need for maintaining the toys in a resalable condition is necessary.

A problem common to stuffed toys is the need to provide some resemblance of organization while the toys are not in use and prevent the toys from becoming soiled. Should a child carry a stuffed toy, if the child drops the toy or handles other objects the toy will become soiled. If a child carries the toy in a backpack, lunch box, or in their pocket, the toy can become damaged. For instance, if the toy is placed in the backpack which is commonly used by children to carry books, the constant impact from books and other sharp objects will subject the toy to premature wear. Similarly, should the toy be placed in a lunch box or in the child's pocket, again it is subjected to various elements, each of which may lead to damage of the toy. In many instances the toy has sentimental value to the child and premature wear, destruction, or loss of the toy could be problematic to the child.

The above problem is enhanced when multiple toys are carried. In addition, the placement of a toy within a container causes the loss of the ornamental enjoyment of the toy. For instance, when a child has placed toys within their backpack they cannot enjoy the toy, nor is it on display for others. Should a second child inquire about the toy, the first child would have to remove the toy from the confines of the container wherein the additional handling of the toy can damage the toy.

Thus, what is lacking in the art is a low cost toy carrier for securing one or multiple toys in a structured setting to assist in protecting the toy from premature wear as well as provide constant display of the toy for the enjoyment by all.

SUMMARY OF THE INVENTION

The instant invention consists of a pocket-shaped carrier having a means for fastening the carrier to a child's backpack, belt loop, belt, or purse strap. The top of the carrier includes an elastic band formed integral thereto providing a securement to the toy placement. The carrier includes openings along a bottom portion for placement of the toy's legs, if present. If the toy lacks legs, the carrier operates as a pocket to secure the toy in position with only the head of the toy protruding from the elastic opening.

The means for fastening is preferably formed from a hook and pile attachment, similar to attachments sold under the trademark VELCRO, which forms an adjustable securement wrap which is placed around a strap and attaches to itself, not to the strap. In this manner, a number of toy carriers may be placed adjacent to each other allowing a child to carry numerous stuffed toys in an organized manner.

The pocket-shaped carrier has a particular shape providing an ornamental style holder and can be made from any type of material. In addition, the carrier may assimilate the material and design of the object it is attached too. For instance, the carrier may resemble a backpack with outside compartments for placement of keys, coins or other small items. The carrier may resemble a purse with outside compartments and have the same color and design print as the purse. Common to the carrier is the open top for placement of the stuffed toy with the fastening means for securement of the carrier to a strap.

The carrier further allows for the organized positioning of a plurality of stuffed toys. For instance, ten or fifteen stuffed toys may be vertically placed behind a child's door by simply placing a like amount of carriers onto a vertical strap attached to the door. The strap may be as simple as a belt hung from a coat hook as the fastening means is adjustable to any size strap. In this manner, the toys can be displayed in a location where they may otherwise be damaged if left unsecured.

The means for fastening may also consist of an enlarged attachment preferably formed from corresponding pieces of hook-and-pile fastening material positioned to form an adjustable securement wrap for placement around the child's ankle or arm. In this manner, the carrier may be positioned similar to a wrist bracelet.

Thus, an object of the instant invention is to provide a carrier that maintains a stuffed toy in a secure position allowing ease of access by any age child.

Yet another object of the instant invention is to provide a reusable carrier device that attaches to a backpack, belt loop, purse, or like objects that form a strap.

Another object of the instant invention is to provide a reusable carrier device that attaches to a child's wrist or ankle, with the attachment made adjustable for accommodating various aged children.

Yet still another object of the invention is to place stuffed toys in a position wherein the head portion and leg portions of the stuffed toy are viewable.

Still another object of the invention is to disclose a carrier that may resemble the item it is attached to as well as incorporate various pockets for storage of small items.

Other objects and advantages of this invention will become apparent from the following description taken in conjunction with the accompanying drawings wherein are set forth, by way of illustration and example, certain embodiments of this invention. The drawings constitute a part of this specification and include exemplary embodiments of the present invention and illustrate various objects and features thereof.

DETAILED DESCRIPTION OF THE PREFERRED EMBODIMENT

Although the invention will be described in terms of a specific embodiment, it will be readily apparent to those skilled in this art that various modifications, rearrangements and substitutions can be made without departing from the spirit of the invention. The scope of the invention is defined by the claims appended hereto.

Figure 1:
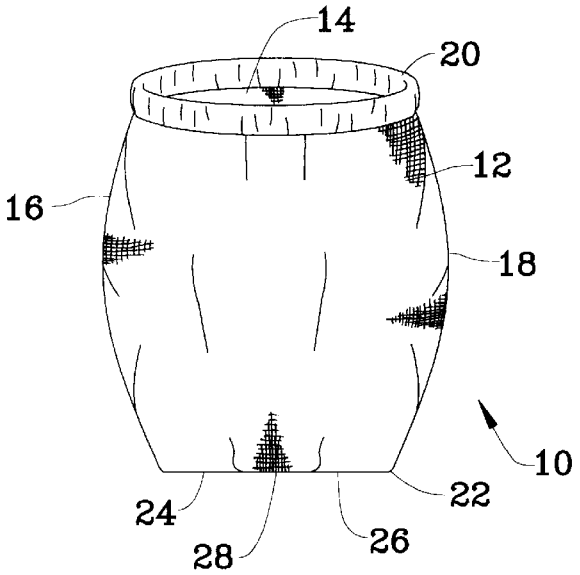
FIG. 1 is a perspective view of the toy carrier of the instant invention.
Figure 3:
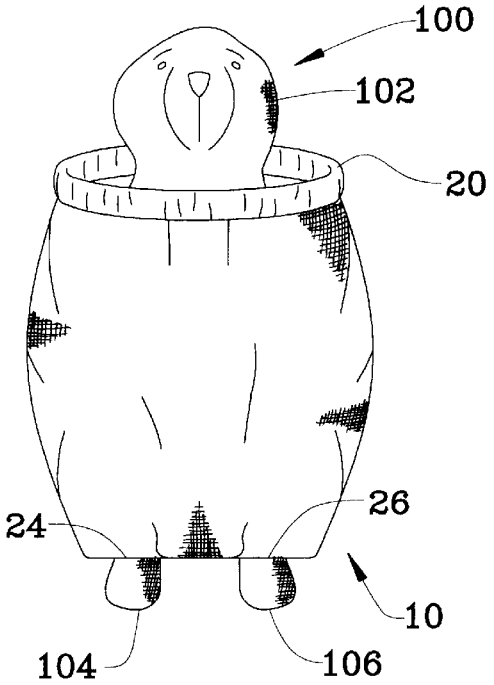
FIG. 3 is a pictorial of the invention, having a stuffed toy placed within the carrier.
Figure 2:
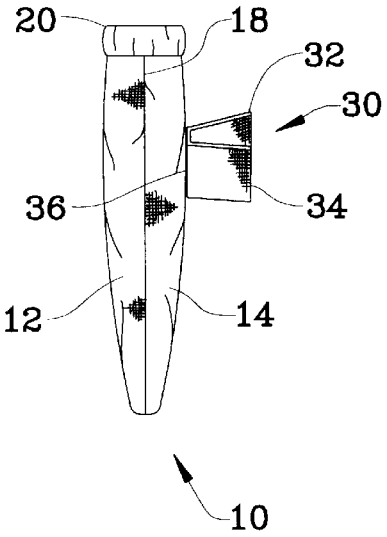
FIG. 2 is a side view of FIG. 1.

Referring now in general to FIGS. 1–3, set forth is the preferred embodiment of the instant invention which consists of a stuffed toy carrier 10 having a front panel 12 and a rear panel 14 joined together by an inverted seam on a first side edge 16 and a second side edge 18. The upper rim 20 of the carrier forms a circular shape having a diameter which is pulled constricted by use of an elastic band formed integral to the upper rim 20. The bottom edge 22 of the toy carrier 10 includes leg openings 24 and 26 separated by centrally disposed securement area 28 formed by an inverted seam. As shown in FIG. 2, the front panel 12 and the rear panel 14 are joined by an inverted seam illustrated along securement line 18. The fastening mechanism 30 consists of an overlapping panel 32 having a hook and pile attachment operatively associated with overlapping panel 34, operation of the panels will be described in detail later in the specification. A middle panel 13 of the fastening mechanism 30 is securely attached to the rear panel 14, along seam 36. Although the middle panel 13 is preferably sewn to the rear panel 14, other attachment methods, such as adhesives, may also be used.

Referring to FIG. 3, set forth is a pictorial of a stuffed toy 100 placed within the carrier 10 wherein the head portion 102 of the toy extends above the rim 20. The body of the stuffed toy is placed within the chamber formed by the carrier having legs 104 and 106 placed through apertures 24 and 26 respectively. The structure 10 may be formed from any type of flexible cloth material. The cloth material may consist of any type of design pattern which may or may not match the individual stuffed toy placed therein and is preferably larger in the center section with the upper portion formed inwardly providing a neck around the stuffed toy's head and again with the structure narrowing towards support of the legs.

The carrier may assimilate the material and design of the object it is attached too. For instance, the carrier 10 may resemble a backpack with outside compartments, for example compartments 126,128 and 130 in FIG. 4, for placement of keys, coins or other small items. The carrier may resemble a purse with outside compartment and have the same color and design print as the purse. Common to the carrier is the open top for placement of the stuffed toy with the fastening means for securement of the carrier to a strap.

Figure 4:
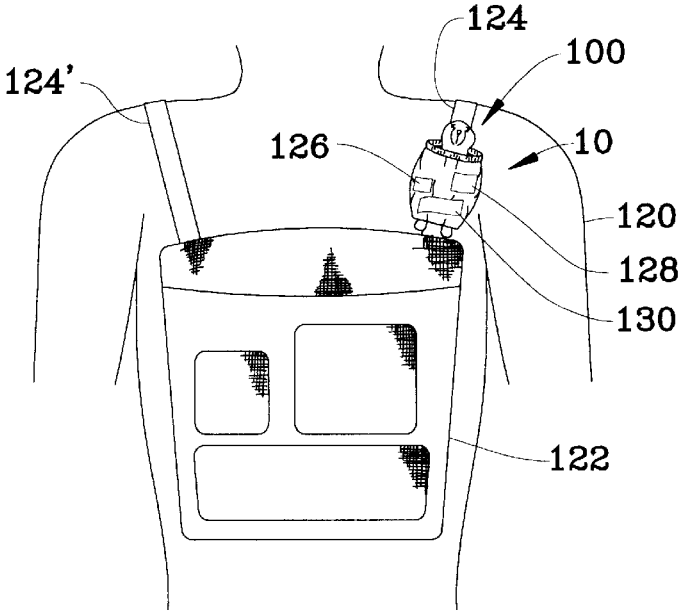
FIG. 4 is a pictorial view of a child with a backpack and a stuffed toy attached to the stuffed toy carrier attached to one of the straps.

As shown in FIG. 4, the carrier 10 can be secured to a strap such as that shown on the child 120 having backpack 122 with vertical strap 124 used for holding of the backpack in position. The securement device can be attached to the backpack with or without the stuffed toy. Once the carrier is secured, the toy may be positioned in later and pulled out of the carrier as needed.

Figure 5:
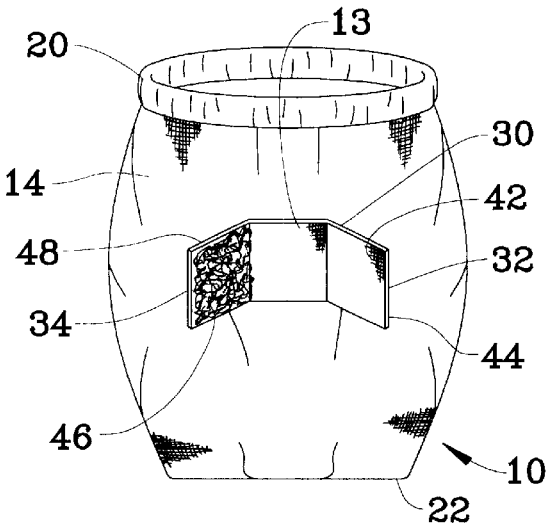
FIG. 5 is a rear view showing the attachment mechanism in an open position.

Now referring to FIG. 5, shown is the rear view of the carrier 10 having the upper rim 20 formed from the elastic band integrated therein. Bottom edge 22 includes the leg apertures as depicted in FIGS. 1 and 3, for placement of the stuffed toy's feet therethrough. A fastening mechanism 30 is attached to the back panel 14. In a preferred embodiment, the fastening mechanism 30 is a rectangular piece of material that is divided into three sections of equally or substantially-equal size. More specifically, the fastening mechanism 30 includes a first overlapping panel 32 spaced apart from a second overlapping panel 34 by a middle portion 13. The middle portion 13 is attached to the carrier rear panel 14. The first overlapping panel 32 includes an inner surface 42 and an outer surface 44. The second overlapping panel 34, which is a mirror image of the first overlapping panel 32, also includes an inner surface 46 and an outer surface 48.

Figure 6:
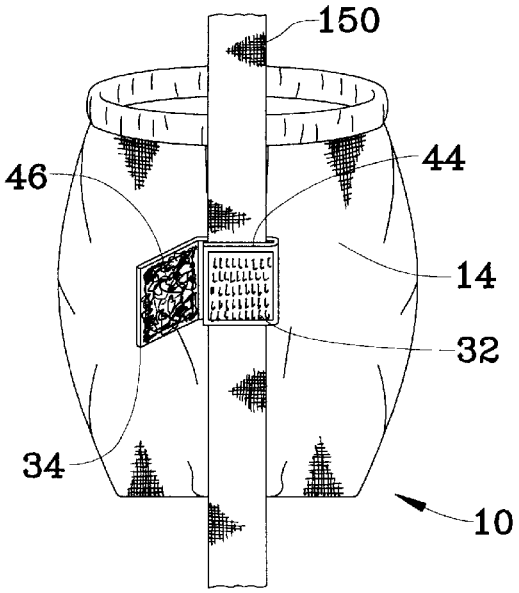
FIG. 6 shows the attachment mechanism in a half-closed position wrapped round a vertical strap.

As shown in FIG. 6, the carrier 10 is secured to a vertical strap 150 by placement of the vertical strap across rear panel 14 wherein first overlapping panel 32 is placed over the strap with side surface 42 abutting said strap 150 and outer surface 44 which has a hook-and-pile-type fastening material in this embodiment surface 44 has the hook portion of the hook and pile. The second overlapping panel 34 includes surface 46 having the pile which allows for attachment to the hook portion of the first overlapping panel 32.

Figure 7:
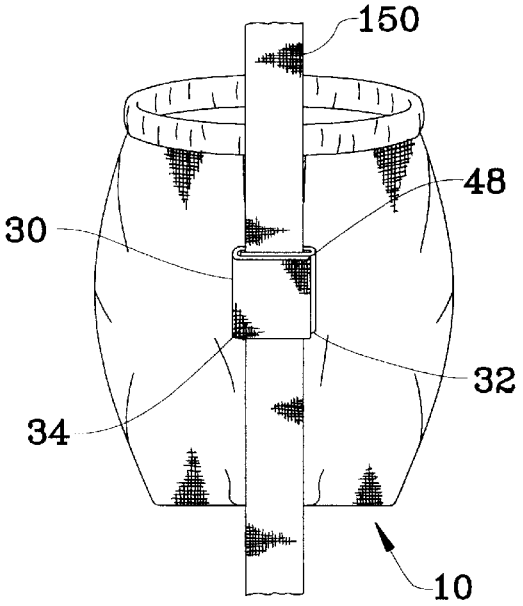
FIG. 7 shows the attachment mechanism in a closed position wrapped around a vertical strap.

As set forth in FIG. 7, the carrier is shown secured to the strap 150 wherein second overlapping panel 34 is placed over first overlapping panel 32 with outer surface 48, shown exposed, and inner surface 46, not shown, now engaging the hook portion of the carrier. The carrier 10 thereby securely attaches to the strap 150 in such a manner so as to prevent disengagement as surface 48 is typically placed against the body of the child so as to prevent accidental opening of the carrier.

Figure 8:
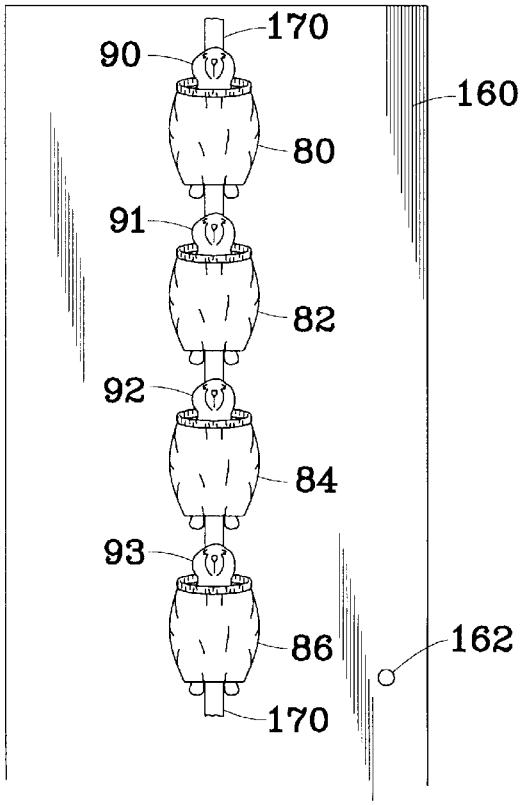
FIG. 8 is a pictorial view of multiple carriers on a vertical strap shown placed against the back of a bedroom door.

Referring now to FIG. 8, set forth is a pictorial of a door 160 having handle 162 with strap 170 attached to top of the door with a plurality of carriers 80, 82, 84, and 86 secured to the strap 170. In this manner, each of the stuffed animals as depicted by numerals 90–93 are placed in a predetermined position and held in a secure position allowing for their ornamental display as well as the protection of the stuffed toys which, as previously explained, are in many cases an investment.

It is to be understood that while a certain form of the invention is illustrated, it is not to be limited to the specific form or arrangement of parts herein described and shown. It will be apparent to those skilled in the art that various changes may be made without departing from the scope of the invention and the invention is not to be considered limited to what is shown in the drawings and described in the specification.

What is claimed is:

1. A stuffed toy pouch comprising:

a pocket structure including a first panel joined to a second panel; said first panel having an upper edge, a first side edge, a second side edge, and a bottom edge, each of said first panel side edges extending between said first panel upper edge and said first panel bottom edge; said second panel having an upper edge, a first side edge, a second side edge, and a bottom edge, each of said second panel side edges extending between said second panel upper edge and said second panel bottom edge; said first and second side edges of said first panel joined to corresponding said first and second side edges of said second panel; said first panel bottom edge having a central portion joined to a central portion of said second panel bottom edge; and a means for fastening said pocket structure to a strap, said means for fastening being a rectangular sheet of flexible material having a first and second side surface divided into three sections defining a centrally disposed backing section permanently secured to said first panel with a first and second overlapping section extending therefrom having a hook and pile securement between said overlapping sections;

whereby the coupling of said first panel to said second panel forms a pocket structure having an enlarged opening along said upper edges, a first leg opening, and a second leg opening, said leg openings located along opposite sides of said joined portions of said bottom edges, wherein said pocket structure allows insertion of a stuffed toy therein thereby forming a stuffed pocket structure, with a head of the stuffed toy protruding from said enlarged opening, and with legs of the stuffed toy protruding from said leg openings, said means for fastening allowing said stuffed pocket structure to be secured to a strap.

2. The stuffed toy pouch according to claim 1 wherein said first panel upper edge cooperates with said second panel upper edge to form a continuous pocket structure top edge that includes an elastic band, said elastic band sized to selectively reduce said pocket structure opening size.

3. The stuffed toy pouch according to claim 2 wherein said elastic band is formed integral to said continuous edge.

4. The stuffed toy pouch according to claim 1 wherein: said first overlapping section has an inner surface for use in overlapping a strap placed adjacent said backing section and an outer surface having a hook material; and said second overlapping section has an inner surface with a pile material to engage said hook material in a fixed position.

5. The stuffed toy pouch according to claim 4 wherein said rectangular sheet of material is secured parallel to said upper edge allowing the fastening of said stuffed toy pouch to a vertical strap.

6. The stuffed toy pouch according to claim 1 wherein said first panel is further defined as having a substantially straight upper edge and lower edge with said opposite side edges forming a curvature therebetween.

7. The stuffed toy pouch according to claim 1 wherein said second panel forms a mirror image of said first panel.

8. The stuffed toy pouch according to claim 1 wherein said first panel and said second panel are constructed from cloth.

9. The stuffed toy pouch according to claim 1 wherein said first overlapping section has an inner surface for use in overlapping a strap placed adjacent said backing section and an outer surface having a pile material; and said second overlapping section has an inner surface with a hook material to engage said pile material in a fixed position.

10. The stuffed toy pouch according to claim 9 wherein said rectangular sheet of material is secured parallel to said upper edge allowing the fastening of said stuffed toy pouch to a vertical strap.

11. A stuffed toy pouch comprising:

a pocket structure including a first panel joined to a second panel; said first cloth panel having an upper edge, a first side edge, a second side edge, and a bottom edge, each of said first panel side edges extending between said first panel upper edge and said first panel bottom edge; said second cloth panel having an upper edge, a first side edge, a second side edge, and a bottom edge, each of said second panel side edges extending between said second panel upper edge and said second panel bottom edge; said first and second side edges of said first panel joined to corresponding said first and second side edges of said second panel; said first panel bottom edge having a central portion joined to a central portion of said second panel bottom edge;

an elastic band formed integral to said upper edge of said first and second panel forming an adjustable opening; and a rectangular sheet of cloth material having a first and second side surface divided into three equally dimensioned sections by defining a centrally disposed backing section permanently secured to said first panel with a first and second overlapping section extending therefrom having a hook and pile securement between said overlapping sections;

whereby the coupling of said first panel to said second panel forms a pocket structure having an enlarged opening along said upper edges and a first and second leg opening along said bottom edge, wherein said pocket structure is available for insertion of a stuffed toy allowing the head of the stuffed toy to protrude from said enlarged opening with the legs of the stuffed toy protruding from said leg openings, said means for fastening allowing said stuffed toy pouch to be secured to a strap.

12. The stuffed toy pouch according to claim 11 wherein said first panel is further defined as having a substantially straight upper edge and lower edge with said opposite side edges forming a curvature therebetween.

13. The stuffed toy pouch according to claim 11 wherein said second panel forms a mirror image of said first panel.

14. The stuffed toy pouch according to claim 11 wherein said rectangular sheet of material is secured parallel to said upper edge allowing the fastening of said stuffed toy pouch to a vertical strap.

15. The stuffed toy pouch according to claim 11 including at least one pocket structure formed on an outer surface of one of said panels for placement of small items.

* * * * *